US009168992B2

(12) United States Patent
Takewaki et al.

(10) Patent No.: US 9,168,992 B2
(45) Date of Patent: Oct. 27, 2015

(54) FUEL SUPPLY SYSTEM OF OUTBOARD MOTOR

(71) Applicant: SUZUKI MOTOR CORPORATION, Hamamatsu-shi, Shizuoka (JP)

(72) Inventors: Hiromichi Takewaki, Hamamatsu (JP); Gen Akutsu, Hamamatsu (JP)

(73) Assignee: SUZUKI MOTOR CORPORATION, Tokyo (JP)

( * ) Notice: Subject to any disclaimer, the term of this patent is extended or adjusted under 35 U.S.C. 154(b) by 243 days.

(21) Appl. No.: 13/736,449

(22) Filed: Jan. 8, 2013

(65) Prior Publication Data

US 2013/0178119 A1 Jul. 11, 2013

(30) Foreign Application Priority Data

Jan. 10, 2012 (JP) ..... 2012-002457

(51) Int. Cl.

| | |
|---|---|
| ***F02M 37/20*** | (2006.01) |
| ***B63H 20/00*** | (2006.01) |
| ***F02B 61/04*** | (2006.01) |
| ***F02M 37/00*** | (2006.01) |

(52) U.S. Cl.

CPC ..... *B63H 20/001* (2013.01); *F02B 61/045* (2013.01); *F02M 37/007* (2013.01); *F02M 37/20* (2013.01)

(58) Field of Classification Search

CPC ..... F02M 37/20; F02M 25/08; F02B 61/045
USPC ..... 440/88 F; 123/195 P, 516
See application file for complete search history.

(56) References Cited

U.S. PATENT DOCUMENTS

| | | | | |
|---|---|---|---|---|
| 6,367,451 | B2 * | 4/2002 | Kato | 123/456 |
| 6,662,786 | B2 | 12/2003 | Watanabe | |
| 6,763,795 | B2 * | 7/2004 | Takahashi | 123/195 P |
| 7,401,598 | B2 * | 7/2008 | Ochiai | 123/516 |
| 2001/0029927 | A1 | 10/2001 | Kato | |
| 2002/0124835 | A1 | 9/2002 | Watanabe | |
| 2005/0005915 | A1 | 1/2005 | Saito | |
| 2009/0071448 | A1 | 3/2009 | Smith et al. | |

FOREIGN PATENT DOCUMENTS

| | | | |
|---|---|---|---|
| JP | 10-218089 | A | 8/1998 |
| JP | 2002-235627 | A | 8/2002 |

OTHER PUBLICATIONS

Extended European Search Report, dated May 8, 2013, which issued during the prosecution of European Patent Application No. 13150082.9.

* cited by examiner

*Primary Examiner* — Edwin Swinehart
(74) *Attorney, Agent, or Firm* — Troutman Sanders LLP

(57) ABSTRACT

A fuel supply system of an outboard motor for supplying a fuel stored in a fuel tank to an intake port of an engine includes: a vapor separator which is disposed on one of left and right sides of the engine in terms of a traveling direction of a hull and to whose upper portion a vapor vent pipe having a tip open to an atmosphere is connected; and an in-line high-pressure fuel pump which is connected to the vapor separator via a fuel pipe and to whose upper portion an air vent pipe passing a position higher than the fuel pipe is connected, wherein the vapor vent pipe includes a folded portion formed so as to extend toward the other side out of the left and right sides of the engine and thereafter return to the one side.

5 Claims, 10 Drawing Sheets

FUEL SUPPLY SYSTEM OF OUTBOARD MOTOR

CROSS-REFERENCE TO RELATED APPLICATIONS

This application is based upon and claims the benefit of priority of the prior Japanese Patent Application No. 2012-002457, filed on Jan. 10, 2012, the entire contents of which are incorporated herein by reference.

BACKGROUND OF THE INVENTION

1. Field of the Invention

The present invention relates to a fuel supply system of an outboard motor for supplying a fuel stored in a fuel tank to an intake port of an engine.

2. Description of the Related Art

An outboard motor often used in a small craft is generally provided with a fuel supply system for supplying an intake port of an engine of the outboard motor with a fuel stored in a fuel tank provided on a hull side.

In this fuel supply system, a vapor separator for separating the fuel such as gasoline sucked up from the fuel tank by a low-pressure fuel pump into gas and liquid to release fuel vapor into the atmosphere, a fuel cooler for cooling the fuel having passed through the vapor separator by cooling water (seawater), a high-pressure fuel pump for pumping the fuel having passed through the fuel cooler, a pressure regulator for adjusting pressure of the fuel, an injector for injecting the fuel whose pressure has been adjusted by the pressure regulator to the intake port of the engine, and so on are generally provided.

As a conventional fuel supply system of this type, for example, one in which a high-pressure fuel pump and a pressure regulator are integrally provided in a case of a vapor separator and a water jacket (fuel cooler) for cooling the fuel is also provided in the case of the vapor separator, whereby a fuel system is simplified (for example, refer to Patent Document 1), and the like are publicly known.

However, in this fuel supply system, since the vapor separator and the high-pressure fuel pump are integrally provided, the size of the vapor separator becomes large for an outboard motor, which has a problem of difficulty in making the outboard motor compact.

Therefore, conventionally, a fuel supply system provided with what is called an in-line high-pressure fuel pump connected in the middle of a fuel pipe and also is provided with a vapor separator having an atmosphere open valve for vapor vent (for example, refer to Patent Document 2) and the like have been publicly known.

[Patent Document 1] Japanese Laid-open Patent Publication No. 10-218089

[Patent Document 2] Japanese Laid-open Patent Publication No. 2002-235627

However, generally adopting a structure in which an air vent pipe of the high-pressure fuel pump is returned to the vapor separator, the above-described conventional fuel supply system using the in-line high-pressure fuel pump has a problem that during the operation, the high-pressure fuel pump sucks the fuel inside the vapor separator through the air vent pipe, which is liable to disable the discharge of the air inside the high-pressure fuel pump.

Another problem is that the outboard motor, when detached from a stern board for maintenance or the like, is usually placed on a floor in a lying posture with its vapor separator side down, and at this time, the fuel is liable to leak from the vapor vent pipe or the like of the vapor separator.

SUMMARY OF THE INVENTION

The present invention was made to solve the above-described problems and has an object to provide a fuel supply system of an outboard motor which makes it possible to surely discharge the air in a high-pressure fuel pump during the operation of the outboard motor and prevent the leakage of the fuel regardless of the posture of the outboard motor.

To attain the above object, the present invention is a fuel supply system of an outboard motor for supplying a fuel stored in a fuel tank to an intake port of an engine, the fuel supply system including: a vapor separator which is disposed on one of left and right sides of the engine in terms of a traveling direction of a hull and to whose upper portion a vapor vent pipe having a tip open to an atmosphere is connected; and an in-line high-pressure fuel pump which is connected to the vapor separator via a fuel pipe and to whose upper portion an air vent pipe passing a position higher than the fuel pipe is connected, wherein the vapor vent pipe includes a folded portion formed so as to extend toward the other side out of the left and right sides and thereafter return to the one side.

Further, in the fuel supply system of the outboard motor according to the present invention, in a plane view, the air vent pipe of the high-pressure fuel pump may pass a position deviating from a recoil cover provided on an upper side of the engine, which position is closer to the one side than the folded portion of the vapor vent pipe, to be connected to the upper portion of the vapor separator.

Further, in the fuel supply system of the outboard motor according to the present invention, in a plane view, the air vent pipe of the high-pressure fuel pump may pass a position deviating from a recoil cover provided on an upper side of the engine, which position is closer to the one side than the folded portion of the vapor vent pipe, and join the vapor vent pipe of the vapor separator to be open to the atmosphere, with the folded portion being formed after a joining portion of the air vent pipe and the vapor vent pipe.

Further, in the fuel supply system of the outboard motor according to the present invention, in a plane view, the air vent pipe of the high-pressure fuel pump may pass a position above a recoil cover provided on an upper side of the engine, which position is closer to the one side than the folded portion of the vapor vent pipe, to be connected to the upper portion of the vapor separator.

Further, in the fuel supply system of the outboard motor according to the present invention, the air vent pipe of the high-pressure fuel pump may join the vapor vent pipe above the recoil cover provided on an upper side of the engine to be open to the atmosphere, with the folded portion being formed after a joining portion of the air vent pipe and the vapor vent pipe.

Further, in the fuel supply system of the outboard motor according to the present invention, the air vent pipe of the high-pressure fuel pump may pass a position above a recoil cover provided on an upper side of the engine, which position is closer to the other side than the folded portion of the vapor vent pipe, to be solely open to the atmosphere.

DETAILED DESCRIPTION OF THE PREFERRED EMBODIMENTS

Hereinafter, embodiments of the present invention will be described with reference to the drawings. Note that in the following description, front, rear, left, and right directions are based on a travelling direction of a hull.

First Embodiment

Figure 1:
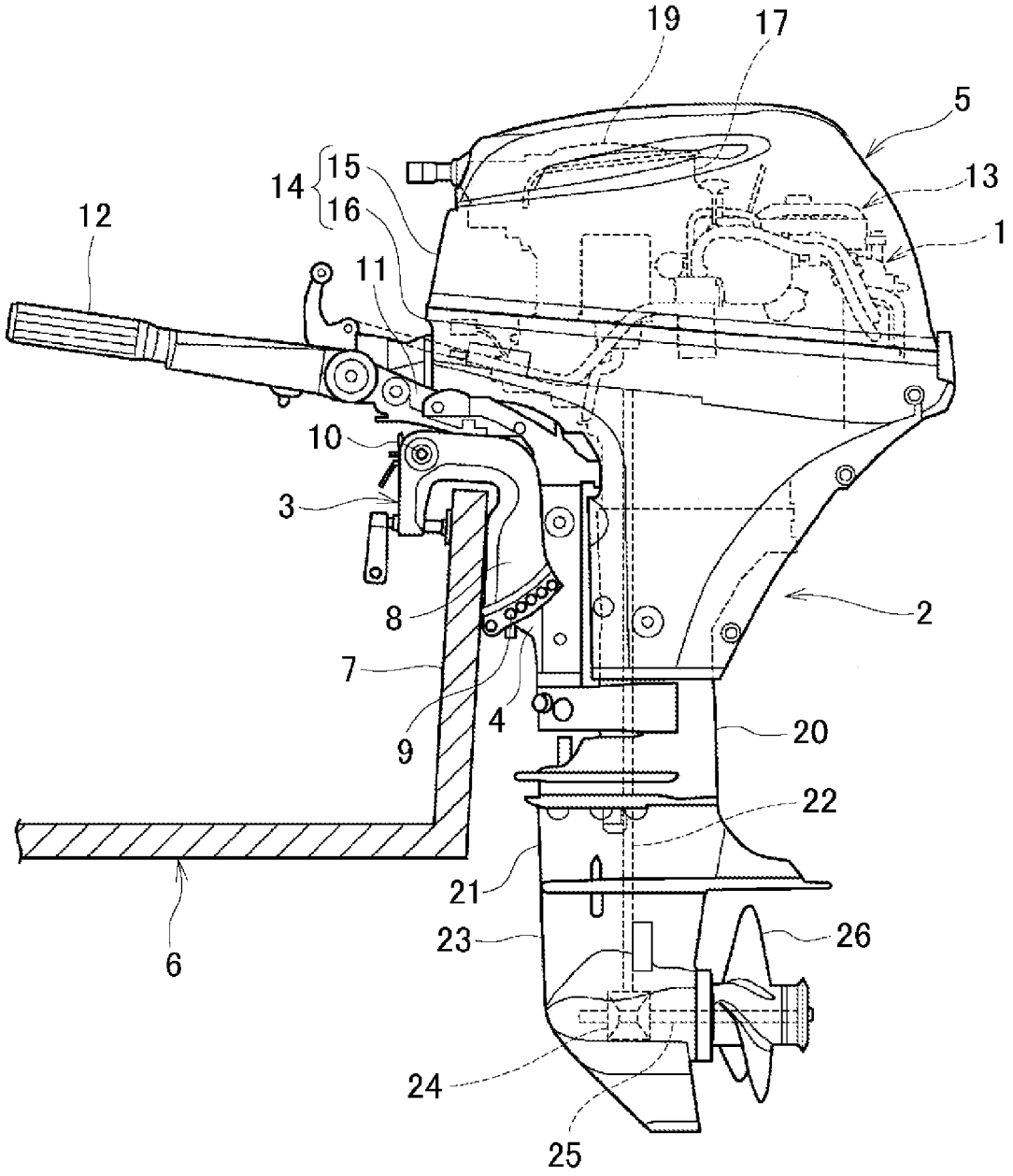
FIG. 1 is a left side view showing an outboard motor including a fuel supply system according to a first embodiment.

FIG. 1 is a left side view showing an outboard motor 2 including a fuel supply system according to a first embodiment of the present invention. The outboard motor 2 is mainly composed of a pair of left and right clamp brackets 3, a swivel bracket 4 provided to be tiltable in an up and down direction relatively to the clamp brackets 3, and an outboard motor body 5 held by the swivel bracket 4.

The clamp brackets 3 are each fixed to a hull 6 so as to sandwich an upper end of a stern board 7, and on lower ends thereof, leg portions 8 are formed in parallel so as to face each other. A plurality of pin holes 9 are bored in each of the leg portions 8, and in a side view, the pin holes 9 are arranged in a substantially arc shape with respect to a tilt shaft 10.

The swivel bracket 4 is disposed so as to be fitted between the clamp brackets 3, and an upper portion of the swivel bracket 4 is pivotally supported on upper portions of the clamp brackets 3 via the tilt shaft 10, thereby capable of tilting in the up and down direction. On a rear portion of the swivel bracket 4, a pivot shaft is pivotably provided, and this pivot shaft is coupled to the outboard motor body 5. An upper end portion of the pivot shaft projects forward to form a steering bracket 11, and a steering handle 12 is pivotably attached to the steering bracket 11.

An engine 13 is installed in an upper portion of the outboard motor body 5, and its periphery is covered by an engine cover 14. The engine cover 14 is vertically dividable into an upper cover 15 and a lower cover 16, the upper cover 15 covering an upper portion of the engine 13 and the lower cover 16 covering a lower portion of the engine 13.

In the engine 13, a crankshaft is provided in a substantially vertical direction. A recoil 17 is provided on an upper end portion of the crankshaft, and a manual starter rope is wound around the recoil 17. Further, an area above the recoil 17 is covered by a recoil cover 19.

Under the engine cover 14 across an oil pan 20, a drive shaft housing 21 is provided. In the oil pan 20 and the drive shaft housing 21, a drive shaft 22 coupled to a lower end of the crankshaft extends downward, so that a propeller 26 is driven via a bevel gear 24 and a propeller shaft 25 in a gear case 23 provided on a lower portion of the drive shaft housing 21.

Figure 2:
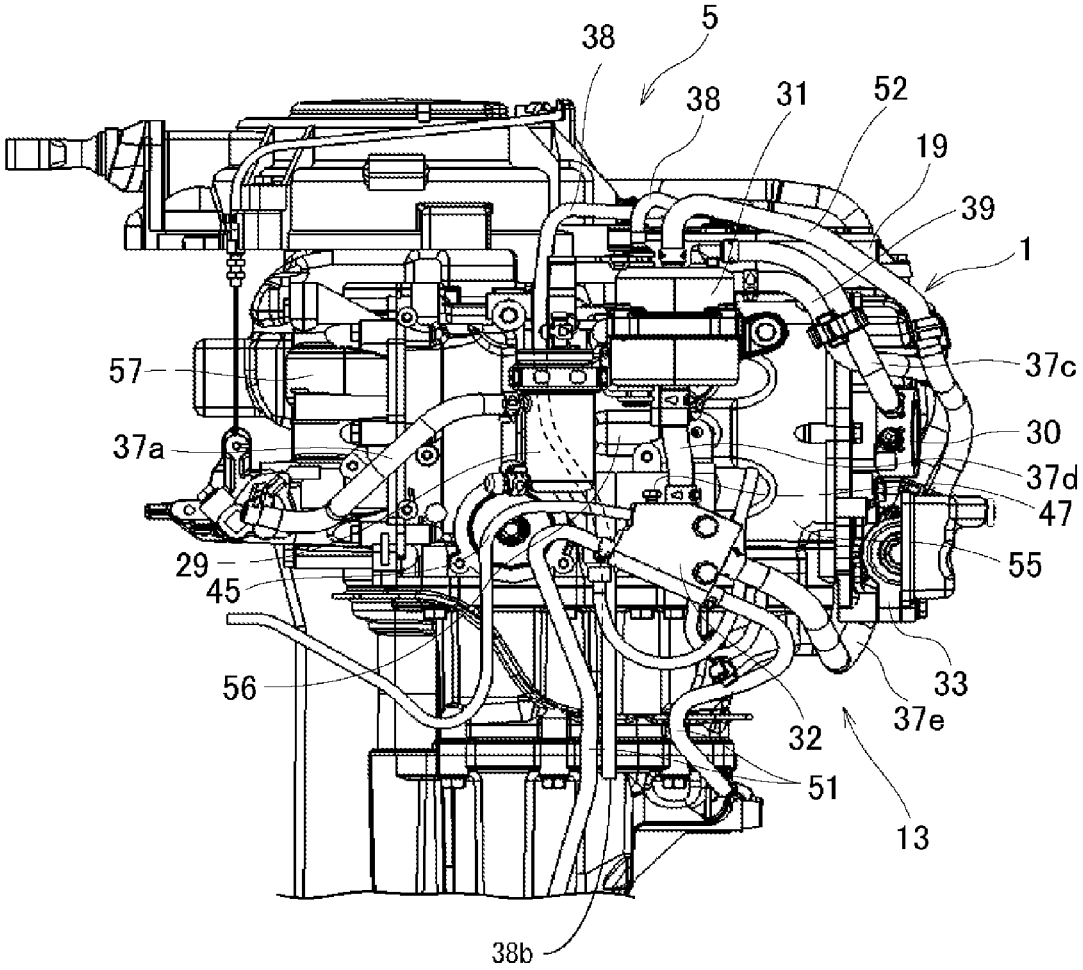
FIG. 2 is a left side view showing an engine including the fuel supply system according to the first embodiment.
Figure 3:
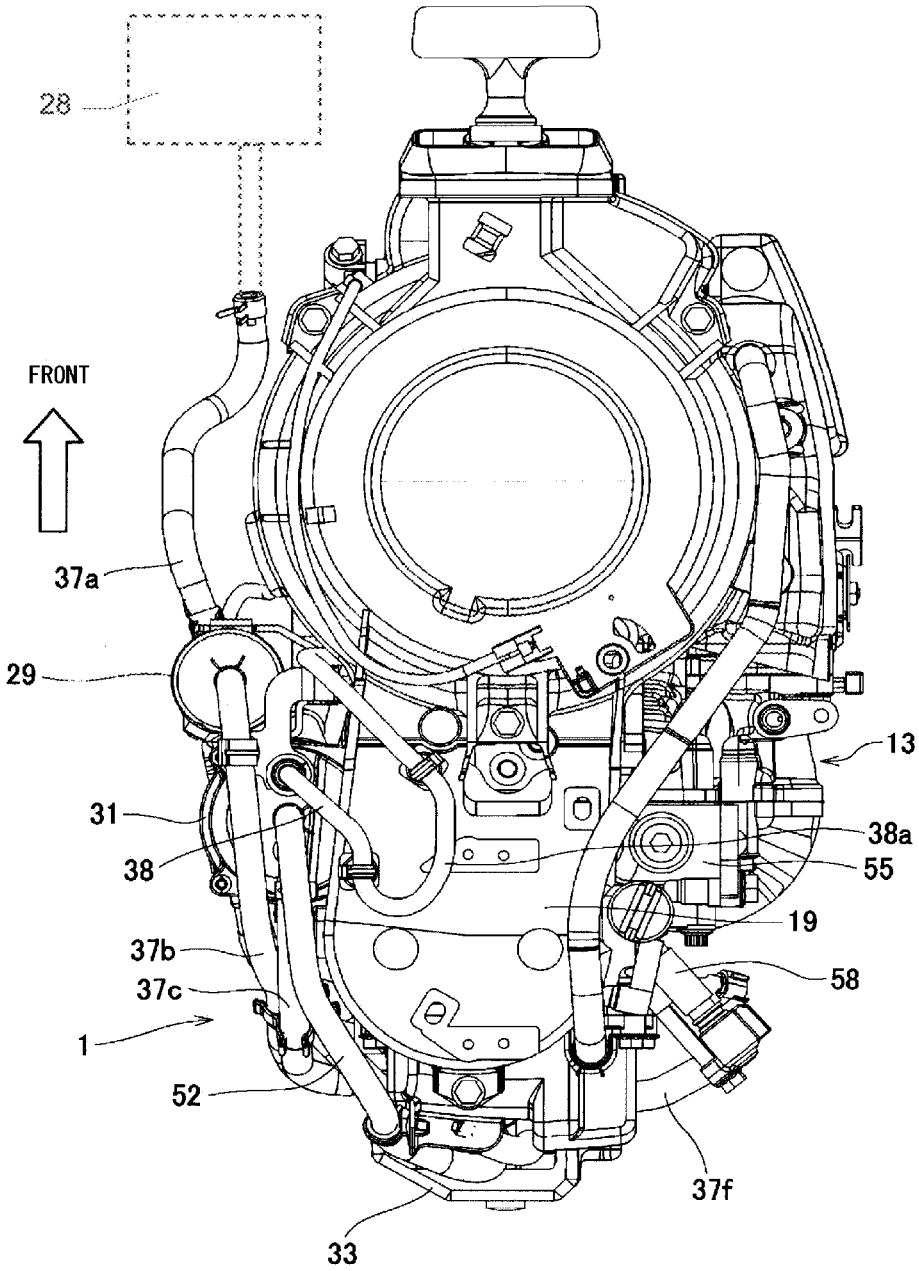
FIG. 3 is a plane view showing the engine including the fuel supply system according to the first embodiment.
Figure 4:
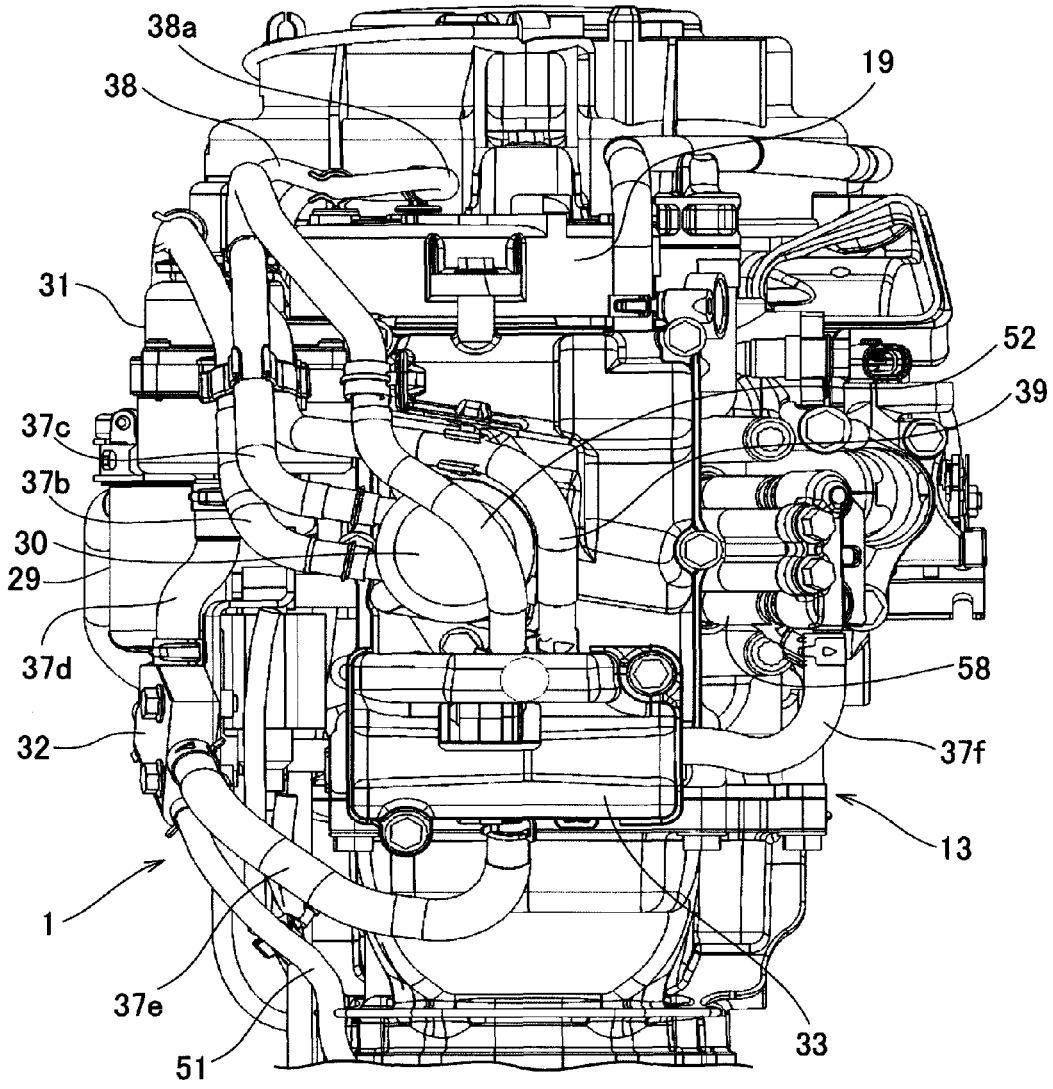
FIG. 4 is a rear view showing the engine including the fuel supply system according to the first embodiment.
Figure 5:
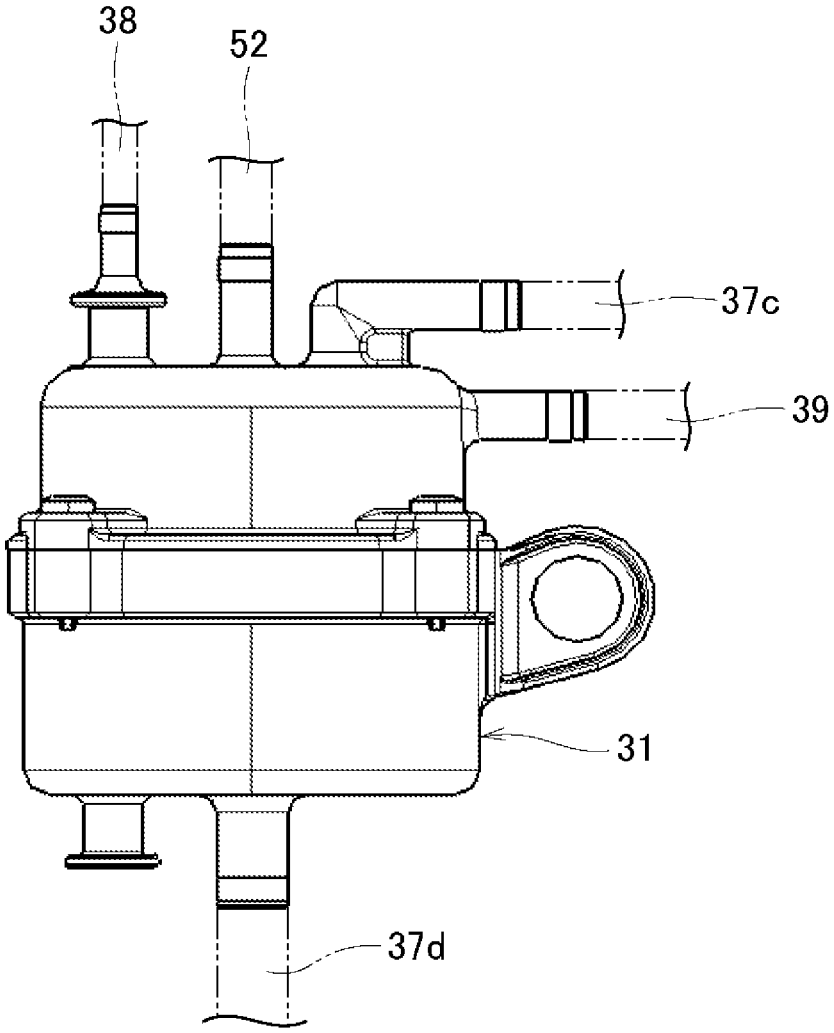
FIG. 5 is a left side view showing a vapor separator of the fuel supply system according to the first embodiment.

Hereinafter, the fuel supply system 1 according to the first embodiment of the present invention will be described in detail with reference to FIG. 2 to FIG. 5. Here, FIG. 2 is a left side view showing the engine including the fuel supply system according to the first embodiment of the present invention. FIG. 3 is a plane view showing the engine including the fuel supply system according to the first embodiment of the present invention. FIG. 4 is a rear view showing the engine including the fuel supply system according to the first embodiment of the present invention. FIG. 5 is a left side view showing a vapor separator of the fuel supply system according to the first embodiment of the present invention.

As shown in FIG. 2 to FIG. 4, the engine 13 is, for example, a water-cooled cycle four-cylinder engine, and is composed of the combination of a cylinder head 55, a cylinder block 56, a crankcase 57, and so on. In the cylinder head 55, an intake port and an exhaust port connecting to a combustion chamber are formed. Further, an injector 58 which injects a fuel into the intake port is attached to the cylinder head 55 from the outside.

Around the engine 13, the fuel supply system 1 is disposed. The fuel supply system 1 is a system to supply the intake port of the engine 13 with the fuel such as gasoline stored in a fuel tank 28 provided on the hull 6 side and is composed of components such as a low-pressure fuel filter 29, a low-pressure fuel pump 30, a vapor separator 31, a fuel cooler 32, a high-pressure fuel pump 33, a pressure regulator and a high-pressure fuel filter which are provided in the high-pressure fuel pump 33, the injector 58, and so on, these components being provided from the fuel tank side toward the intake port.

The low-pressure fuel filter 29 has a substantially columnar outer shape and is disposed at a substantially center portion of a left side of the engine 13. A fuel pipe 37*a* extending from the fuel tank 28 is connected to a front surface of the low-pressure fuel filter 29. The fuel pipe 37*a* is formed so as to tilt up toward the low-pressure fuel filter 29 provided at the rear thereof. Further, a fuel pipe 37*b* extending toward the low-pressure fuel pump 30 is connected to an upper surface of the low-pressure fuel filter 29. The fuel pipe 37*b* is formed so as to tilt down toward the low-pressure fuel pump 30 provided at the rear thereof after rising substantially vertically.

The low-pressure fuel pump 30 has a flat columnar outer shape and is disposed at a substantially center portion of a rear side of the engine 13. The fuel pipe 37*b* extending from the low-pressure fuel filter 29 is connected to a left side surface of the low-pressure fuel pump 30. Further, a fuel pipe 37*c* extending toward the vapor separator 31 is connected to the left side surface of the low-pressure fuel pump 30 so as to be above a connection portion of the fuel pipe 37*b*. These fuel pipes 37*b*, 37*c* both extend upward after extending from the left side surface of the low-pressure fuel pump 30 and are arranged substantially in parallel.

The vapor separator 31 has a substantially columnar outer shape, and on the left side of the engine 13, it is disposed at the rear of and slightly above the low pressure fuel filter 29 so as to be close to the low-pressure fuel filter 29. The fuel pipe 37*c* extending from the low-pressure fuel pump 30 is connected to an upper surface of the vapor separator 31. Further, an air vent pipe 52 of the high-pressure fuel pump 33 is connected to the upper surface of the vapor separator 31 so as to be more forward than a connection portion of the fuel pipe 37*c*. The air vent pipe 52 is disposed above the fuel pipe 37*c*. Further, a vapor vent pipe 38 of the vapor separator 31 is connected to the upper surface of the vapor separator 31 so as to be more forward than a connection portion of the air vent pipe 52.

The vapor vent pipe 38 of the vapor separator 31 includes a folded portion 38*a* that is formed above the recoil cover 19 provided on an upper side of the engine 13, so as to extend toward a right side of the engine 13 and thereafter be folded forward to return to the left side. A tip 38*b* of the vapor vent pipe 38 is open to the atmosphere.

Further, a fuel return pipe 39 extending from the high-pressure fuel pump 33 is connected to a rear surface of the vapor separator 31. Further, a fuel pipe 37*d* extending to the fuel cooler 32 is connected to a lower surface of the vapor separator 31.

The fuel cooler 32 has a flat shape and on the left side of the engine 13, it is disposed under the vapor separator 31. The fuel pipe 37*d* extending from the vapor separator 31 is connected to an upper surface of the fuel cooler 32. Further, a fuel pipe 37*e* extending toward the high-pressure fuel pump 33 is connected to a rear surface of the fuel cooler 32. The fuel pipe 37*e* is formed so as to once tilt down toward the high-pressure fuel pump 33 provided at the rear thereof and thereafter tilt up.

A drain pipe 45 is connected to a front surface of the fuel cooler 32 and a tip of the drain pipe 45 is opened. The drain pipe 45 is formed to be capable of communicating with the fuel pipe 37*e* via a fuel path formed inside the fuel cooler 32, and a valve is interposed in the middle of the fuel path. On the upper surface of the fuel cooler 32, an operation part 47 of the valve is projectingly provided. By inserting a tool such as a socket wrench or a driver from an upper opening portion of the lower cover 16 and operating the operation part 47 to rotate it, it is possible to open/close the fuel path between the drain pipe 45 and the fuel pipe 37*e*.

Further, inside the fuel cooler 32, a cooling water path is penetratingly provided linearly from its front surface lower portion toward its rear surface lower portion, and cooling water pipes 51 are connected to a front inlet and a rear outlet of the cooling water path respectively.

Referring to FIG. 2 and FIG. 3 again, the high-pressure fuel pump 33 is what is called an in-line fuel pump connected in the middle of the fuel pipe to be used and is disposed on the rear side of the engine 13 so as to be under and close to the low-pressure fuel pump 30. The fuel pipe 37*e* extending from the fuel cooler 32 is connected to a lower side of the high-pressure fuel pump 33. Further, the fuel return pipe 39 is connected to an upper side of the high-pressure fuel pump 33, and the fuel return pipe 39 is connected to the rear surface of the vapor separator 31.

Further, the air vent pipe 52 is connected to the upper side of the high-pressure fuel pump 33 so as to be adjacent to the fuel return pipe 39. As shown in FIG. 3, in a plane view, the air vent pipe 52 passes a position deviating from an area above the recoil cover 19, which position is closer to the left side than the folded portion 38*a* of the vapor vent pipe 38. Further, as shown in FIG. 2, the air vent pipe 52 extends upward from the high-pressure fuel pump 33, thereafter curves substantially vertically downward above the vapor separator 31, is connected to the upper surface of the vapor separator 31, and passes a position higher than the fuel pipe 37*e* and the fuel return pipe 39 in a side view.

Further, a fuel pipe 37*f* extending toward the injector 58 is connected to a right side surface of the high-pressure fuel pump 33. The fuel pipe 37*f* is formed so as to extend upward.

Next, the operation of the fuel supply system 1 according to the first embodiment of the present invention will be described.

The fuel in the fuel tank 28 provided on the hull 6 side is sucked up by the low-pressure fuel pump 30, is filtrated by the low-pressure fuel filter 29, thereafter passes through the fuel pipe 37*b* to be led to the low-pressure fuel pump 30, and passes through the fuel pipe 37*c* from the low-pressure fuel pump 30 to be led to the inside of the vapor separator 31.

Inside the vapor separator 31, the fuel is separated into gas and liquid, and fuel vapor is released to the atmosphere through the vapor vent pipe 38, and the liquid of the fuel from which the vapor has been removed passes through the fuel pipe 37*d* to flow into the fuel cooler 32.

In the fuel cooler 32, heat exchange takes place between seawater circulating in the cooling water pipes 51 and the liquid fuel, so that the liquid fuel is cooled, and the liquid fuel is sent to the high-pressure fuel pump 33 through the fuel pipe 37*e*.

Thereafter, the liquid fuel is pumped by the high-pressure fuel pump 33, and after being adjusted in pressure by the pressure regulator and filtrated by the high-pressure fuel filter, the liquid fuel passes through the fuel pipe 37*f* to be sent to the injector 58, and the fuel is sprayed into the intake port by the injector 58.

Here, after extending upward from the high-pressure fuel pump 33 in a side view, the air vent pipe 52 of the high-pressure fuel pump 33 curves substantially vertically downward above the vapor separator 31 to be connected to the upper surface of the vapor separator 31 so as to pass the position higher than the fuel pipe 37*e* and the fuel return pipe 39. Therefore, there is no concern that the high-pressure fuel pump 33 sucks the fuel inside the vapor separator 31 through the air vent pipe 52 during the operation. Consequently, it is possible to surely discharge the air inside the high-pressure fuel pump 33 to the atmosphere via the air vent pipe 52 and the vapor vent pipe 38, which makes it possible to normally operate the high-pressure fuel pump 33.

Further, the air vent pipe 52 of the high-pressure fuel pump 33 passes the shortest route at the position deviating from the area above the recoil cover 19, which position is closer to the left side than the folded portion 38*a* of the vapor vent pipe 38 in a plane view. This makes it possible to make the outboard motor body 5 compact.

Further, the vapor vent pipe 38 of the vapor separator 31 has the folded portion 38*a* which is formed above the recoil cover 19 so as to extend toward the right side of the outboard motor body 5 and thereafter return to the left side. Therefore, even when the outboard motor is detached from the stern board for maintenance or the like and is placed on a floor in a lying posture with its vapor separator 31 side (left side) down, there is no concern about the leakage of the fuel from the vapor vent pipe 38 of the vapor separator 31. This makes it possible to improve maintenability of the outboard motor 2.

Hereinafter, as other embodiments of the present invention, modification examples of the first embodiment will be described. Note that the same constituent elements as those of the first embodiment will be denoted by the same reference signs and a detailed description thereof will be omitted. The description will be focused on what are different from the first embodiment.

Second Embodiment

Figure 6:
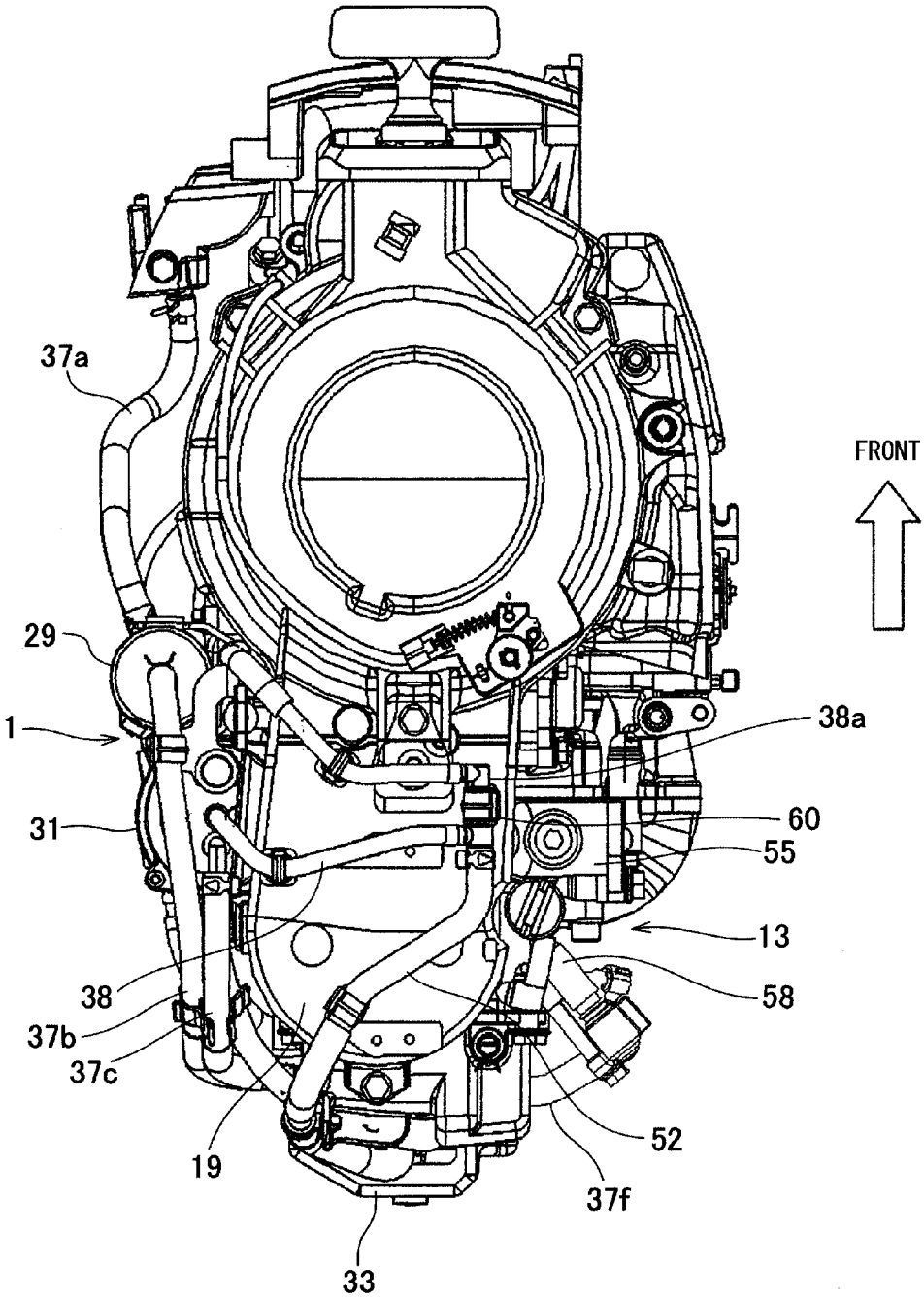
FIG. 6 is a plane view showing an engine including a fuel supply system according to a second embodiment.
Figure 7:
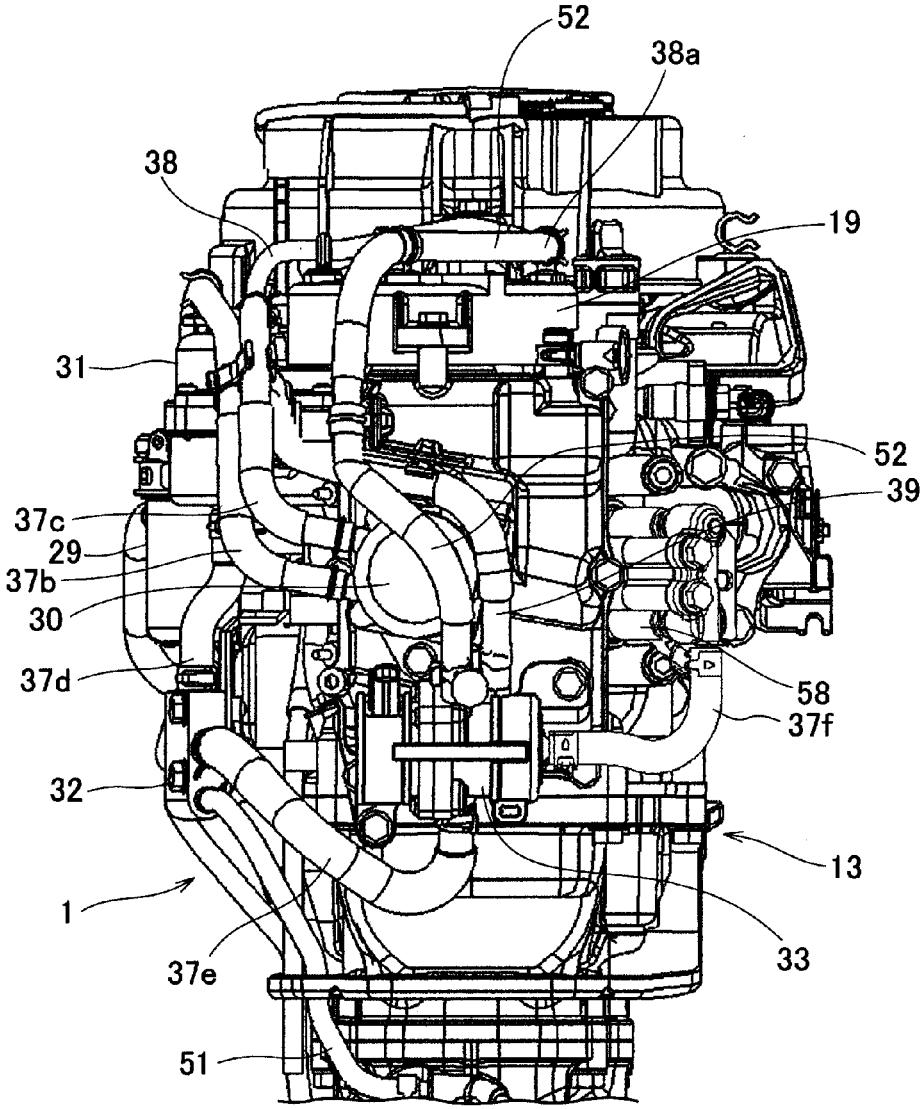
FIG. 7 is a rear view showing the engine including the fuel supply system according to the second embodiment.

As shown in FIG. 6 and FIG. 7, the air vent pipe 52 of the high-pressure fuel pump 33 may join the vapor vent pipe 38 of the vapor separator 31 above the recoil cover 19 to be open to the atmosphere, with the folded portion 38*a* being formed at a position after a joining portion of the air vent pipe 52 and the vapor vent pipe 38. In this case, at the joining portion of the air vent pipe 52 and the vapor vent pipe 38, a 3-way union joint 60 is provided.

Third Embodiment

Figure 8:
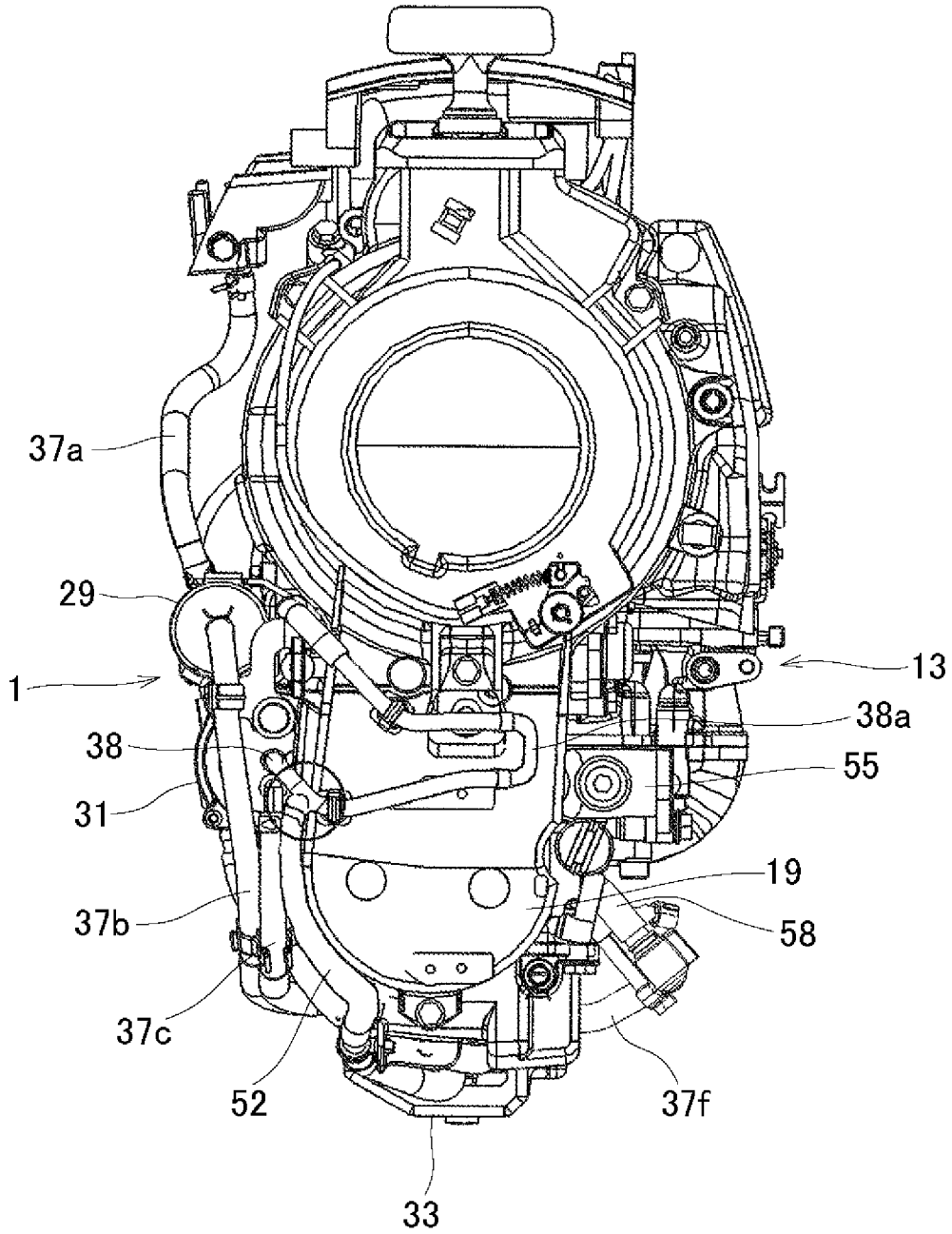
FIG. 8 is a plane view showing an engine including a fuel supply system according to a third embodiment.

As shown in FIG. 8, in a plane view, the air vent pipe 52 of the high-pressure fuel pump 33 may pass a position deviating from the recoil cover 19, which position is closer to the left side than the folded portion 38*a* of the vapor vent pipe 38 of the vapor separator 31 and join the vapor vent pipe 38 of the vapor separator 31 to be open to the atmosphere, with the folded portion 38*a* being formed at a position after a joining portion of the air vent pipe 52 and the vapor vent pipe 38.

Fourth Embodiment

Figure 9:
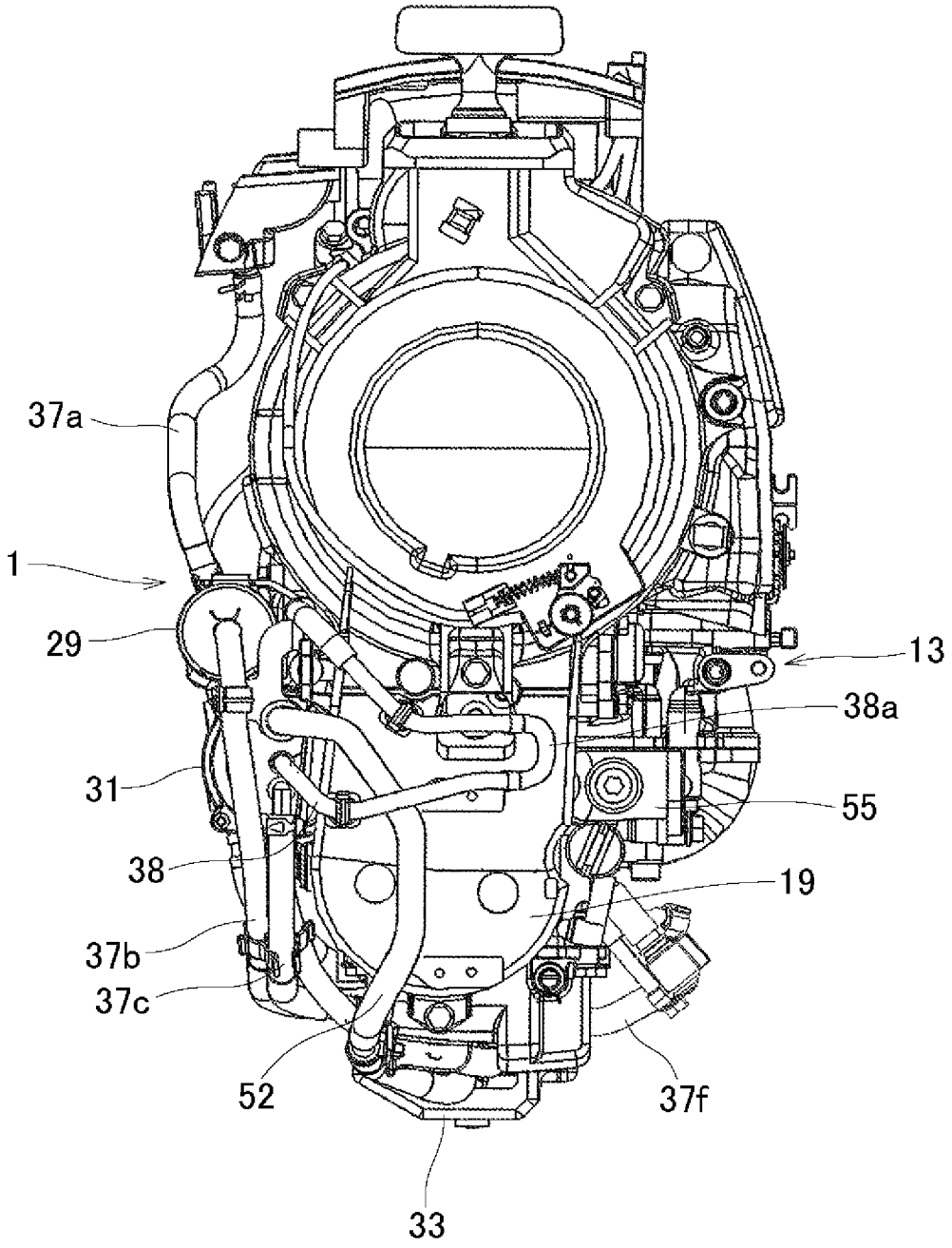
FIG. 9 is a plane view showing an engine including a fuel supply system according to a fourth embodiment.

As shown in FIG. 9, in a plane view, the air vent pipe 52 of the high-pressure fuel pump 33 may pass a position above the recoil cover 19, which position is closer to the left side than the folded portion 38*a* of the vapor vent pipe 38 of the vapor separator 31, to be connected to the upper portion of the vapor separator 31.

Fifth Embodiment

Figure 10:
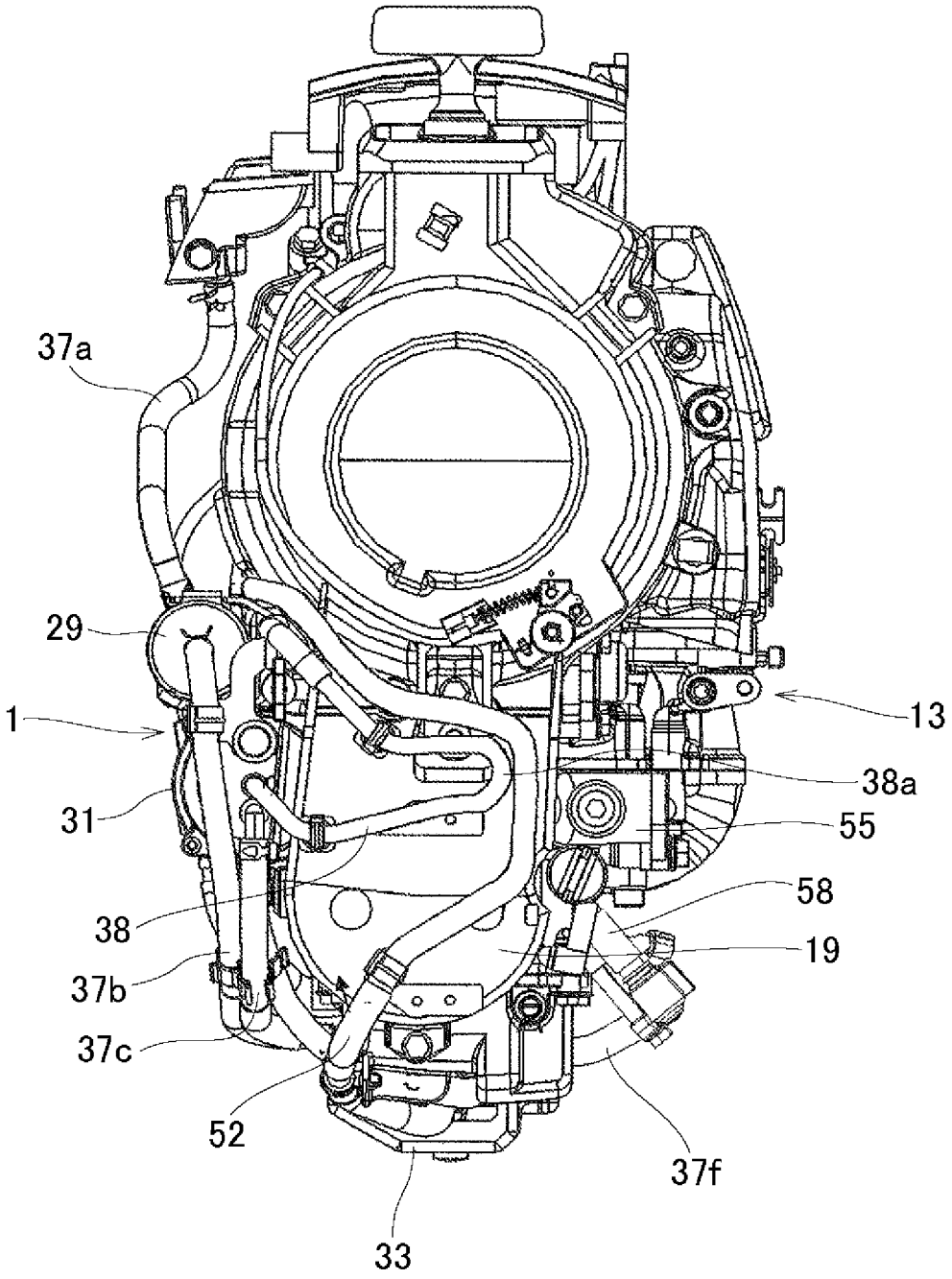
FIG. 10 is a plane view showing an engine including a fuel supply system according to a fifth embodiment.

As shown in FIG. 10, the air vent pipe 52 of the high-pressure fuel pump 33 may pass a position above the recoil cover 19, which position is closer to the right side than the folded portion 38*a* of the vapor vent pipe 38 of the vapor separator 31, in parallel to the vapor vent pipe 38, to be solely open to the atmosphere.

In the description of the foregoing embodiments of the present invention, only suitable examples of the fuel supply system of the outboard motor according to the present invention are shown, and the technical scope of the present invention is not limited to these forms unless there is a description particularly limiting the present invention, and various modifications can be made.

According to the present invention, it is possible to obtain various excellent effects such as that the air in a high-pressure fuel pump can be surely discharged during the operation of an outboard motor, that the leakage of a fuel can be prevented regardless of a posture of the outboard motor, and so on.

What is claimed is:

1. A fuel supply system of an outboard motor, comprising:
a low-pressure fuel filter;
a low-pressure fuel pump;
a vapor separator;
a high-pressure fuel pump; and
an injector provided on an outboard motor side and sequentially connected from a fuel tank side toward an intake port of an engine, in order to supply a fuel stored in a fuel tank provided on a hull side to the intake port, wherein:
the vapor separator disposed on one side of left and right sides of the engine in relation to a traveling direction of a hull, and has an upper portion to which a vapor vent pipe having a tip open to atmosphere is connected;
the high-pressure fuel pump is provided at a position lower than the vapor separator and is connected to the vapor separator via fuel pipes;
the high-pressure fuel pump has an upper portion to which one end of an air vent pipe is connected;
the air vent pipe passes a position higher than the fuel pipes, and has another end communicated with the atmosphere via the vapor vent pipe of the vapor separator; and
the vapor vent pipe includes a folded portion formed so as to extend from the one side of the left and right sides of the engine toward another side of the left and right sides of the engine and thereafter turn back towards the one side of the engine.

2. The fuel supply system of the outboard motor according to claim 1,
wherein the high-pressure fuel pump is disposed on a rear side of the engine in relation to the travelling direction of the hull.

3. The fuel supply system of the outboard motor according to claim 1,
wherein the air vent pipe joins the vapor vent pipe to be open to the atmosphere via the vapor vent pipe.

4. The fuel supply system of the outboard motor according to claim 3,
wherein the air vent pipe joins the vapor vent pipe at a position closer to a vapor separator side than the folded portion of the vapor vent pipe to be open to the atmosphere via the vapor vent pipe.

5. The fuel supply system of the outboard motor according to claim 3,
wherein the air vent pipe joins the vapor vent pipe at the folded portion of the vapor vent pipe to be open to the atmosphere via the vapor vent pipe.

* * * * *